United States Patent [19]

Eriksson

[11] 4,199,110

[45] Apr. 22, 1980

[54] PROCESS AND APPARATUS FOR DISINTEGRATING WASTE PAPER WHILE SEPARATING METALLIC PARTICULATE MATERIAL PRESENT IN THE PAPER

[75] Inventor: Erik F. Eriksson, Johanneshov, Sweden

[73] Assignee: Mo och Domsjo Aktiebolag, Ornskoldsvik, Sweden

[21] Appl. No.: 840,422

[22] Filed: Oct. 7, 1977

[30] Foreign Application Priority Data

Oct. 7, 1976 [SE] Sweden ..... 7611116

[51] Int. Cl.[2] ..... B02C 13/18; B02C 13/282; B02C 13/284

[52] U.S. Cl. ..... 241/20; 241/24; 241/46.17

[58] Field of Search ..... 241/20, 21, 46.08, 46.11, 241/46.17, 24, 46 R, 46 B

[56] References Cited

U.S. PATENT DOCUMENTS

| | | | |
|---|---|---|---|
| 2,340,511 | 2/1944 | Cowles | 241/21 |
| 3,722,832 | 3/1973 | Seifert | 241/46.17 |
| 3,946,951 | 3/1976 | Danforth | 241/21 |
| 4,030,671 | 6/1977 | Coature | 241/46.17 |

FOREIGN PATENT DOCUMENTS

| | | | |
|---|---|---|---|
| 1122361 | 1/1962 | Fed. Rep. of Germany | 241/46.17 |
| 926841 | 10/1947 | France | 241/46.11 |

*Primary Examiner*—Richard B. Lazarus

[57] ABSTRACT

Process and apparatus are provided for disintegrating waste paper containing metallic and similar particulate material appreciably heavier than the paper, and separating the heavier material from an aqueous slurry of disintegrated paper fibers and particles by centrifugal force and gravity settling, comprising disintegrating waste paper in the presence of water while imparting a vortical flow to the resulting slurry of a velocity sufficient to throw relatively heavy particulate material towards the outer periphery of the resulting vortex while lighter waste paper fibers and particles move towards the inner periphery of the vortex; establishing a relatively quiescent zone below the outer periphery of the vortex; permitting the heavier particulate material in that zone to settle out and collect; and withdrawing a slurry of waste paper fibers and particles from an inner peripheral portion of the vortex relatively free from heavier particulate material.

9 Claims, 6 Drawing Figures

PROCESS AND APPARATUS FOR DISINTEGRATING WASTE PAPER WHILE SEPARATING METALLIC PARTICULATE MATERIAL PRESENT IN THE PAPER

Apparatus for disintegrating waste paper or broke normally comprises a tank provided with a rotatable disintegrator or rotor and an outlet for the resulting slurry of disintegrated paper fibers and particles and water. The paper is disintegrated both by the mechanical force of collision with the disintegrator, and by centrifugal force applied to the paper by the whirling vortex created by the rotor in which the paper is suspended.

If the waste paper contains a high proportion of foreign objects, particularly metallic particles, such as staples, baling wires, nails, paper clips and other hard materials, particularly metal objects, breakdowns frequently occur, because these particles tend to get into the rotating machinery. They also cause appreciable abrasion and wear on the rotating parts, and the walls of the tank. Naturally, the particles also interfere with the disintegration of the paper, which may be inefficient, and the dwell time of the paper particles in the tank may be greatly extended before they are reduced to the desired small size.

The only practical way for coping with this problem up until now has been the removal of the foreign objects from the paper. The paper has to be sorted, and the metallic material drawn out by magnets, or by filters, or by hand, which greatly increases the cost of reprocessing the waste paper and recovering useful paper products therefrom. If the recovered waste paper product is to be competitive with fresh paper pulps, the processing costs must be as low as possible, and in most cases, the sorting out of the metallic objects by the available procedures is not warranted economically.

It is possible to remove some or all of the fine metallic material from the tank by suspending in the rotating slurry in the tank a rope or similar material which entangles with the metal particles and thus removes them from the slurry. The rope can be continuously withdrawn at one end, and a fresh length of rope introduced into the slurry at the other end, so that the particles collected on the rope are continuously removed. As the rope is withdrawn, additional material in the tank may form a branch line extending from the rope, referred to as a "ragger", formed of waste material which itself is rope-forming, and held together by elongated metal objects, such as wires. The use of a rope or "ragger" is described in Swedish Pat. No. 139,399, U.S. Pat. No. 2,340,511, patented Feb. 1, 1944, to Cowles. However, the rope may break and the loose end become entangled in the rotor. The proportion of foreign metallic objects in the waste paper varies greatly from batch to batch, and the technique cannot be depended upon to be applicable in all instances. Moreover, the portion of the rope or "ragger" that remains within the tank can result in the formation of large agglomerates of wire and other metallic material, which, by abrasion, can result in appreciable wear of the rotor, and the sides of the tank.

A further problem is that paper of high wet strength is more difficult to disintegrate, and instead of becoming disintegrated, may become entangled in the rope or "ragger", with the result that the yield of disintegrated paper may be reduced considerably, because of the losses of paper material in this way.

In accordance with the invention, process and apparatus are provided for separating the metallic and other particulate material heavier than paper from the disintegrated paper fibers and particles in a manner which prevents the metallic and other heavy material from abrading the tank and rotor, by collecting it in a quiescent zone, where the metallic material is stored and not whirled about in the vortical flow created by the rotatable disintegrator. The quiescent zone is formed by mounting the rotor appreciably above the bottom of the tank, and also by mounting the outlet for aqueous fiber slurry above the bottom of the tank, with a protective weir shielding the outlet from a peripheral zone extending radially outwardly from and below the weir and outlet, and also beneath the outer periphery of the vortex formed in the tank. Since the zone is below the level of the rotor, it is not appreciably affected by the rotating action of the rotor, and is relatively quiescent. Since it is below the level of the outlet, the metallic material can collect there, and will not tend to be drawn out through the outlet by the flow of slurry, simply because it is too heavy to be resuspended in the water, once it has settled out.

The process of the invention for disintegrating waste paper containing metallic and other particulate material appreciably heavier than the paper, and separating the heavier material from an aqueous slurry of disintegrated paper fibers and particles by centrifugal force and gravity settling, comprises disintegrating waste paper in the presence of water while imparting a vortical flow to the resulting slurry, of a velocity sufficient to throw relatively heavy particulate material towards the outer periphery of the resulting vortex, while lighter waste paper fibers and particles move towards the inner periphery of the vortex; establishing a relatively quiescent zone below the outer periphery of the vortex and permitting the heavier particulate material to settle out and collect in that zone; and withdrawing a slurry of waste paper fibers and particles from an inner peripheral portion of the vortex, relatively free from heavier metallic particulate material.

The apparatus of the invention comprises, in combination, a housing; a disintegration chamber in the housing; a rotatable disintegrator mounted in the chamber for disintegrating waste paper in the presence of water and imparting a vortical flow to the resulting slurry of a velocity sufficient to throw relatively heavy particulate material towards the outer periphery of the resulting vortex while waste paper fibers and particles move towards the inner periphery of the vortex; at least one outlet in the chamber adjacent the inner periphery of the vortex and below the rotor for withdrawing a slurry of waste paper fibers and particles; a filter across the outlet permitting only waste paper fibers and particles below a predetermined size to escape from the chamber; and a well in the chamber below the level of the outlet and of the rotatable disintegrator and extending beneath at least the outer periphery of the vortex, radially outward from the outlet, for collection of heavy particulate material thrown to the outer periphery of the vortex and settling out by gravity in a relatively quiescent zone within the well.

There is a considerable analogy between the apparatus of the present invention and a vortex separator, in that the rotatable disintegrator tends to throw the heavier metallic and other particles towards the outer periphery of the vortex by centrifugal force. Unlike a vortex separator, however, the process and apparatus of the invention utilize a relatively quiescent zone below the vortex where the heavier material thrown to the outer periphery of the vortex can be allowed to settle out by gravity, the rotational movement of the vortex in this region being less than will maintain such particles in suspension in the slurry. On the other hand, the lighter paper fibers and particles are drawn towards the center of the vortex, partly because, being lighter and/or flat, they are not as susceptible to the outward centrifugal force applied in the vortex, and partly because of the flow of water towards the center of the vortex, as is normal in vortex separators and hydrocyclones, as a result of centrifugal and velocity forces, which are well known. Accordingly, the paper fibers and particles are separated from the heavier metallic and other material, and can be withdrawn from the inner periphery of the vortex, substantially free from such material.

Preferred embodiments of the apparatus of the invention are illustrated in the drawings, in which.

Figure 1:
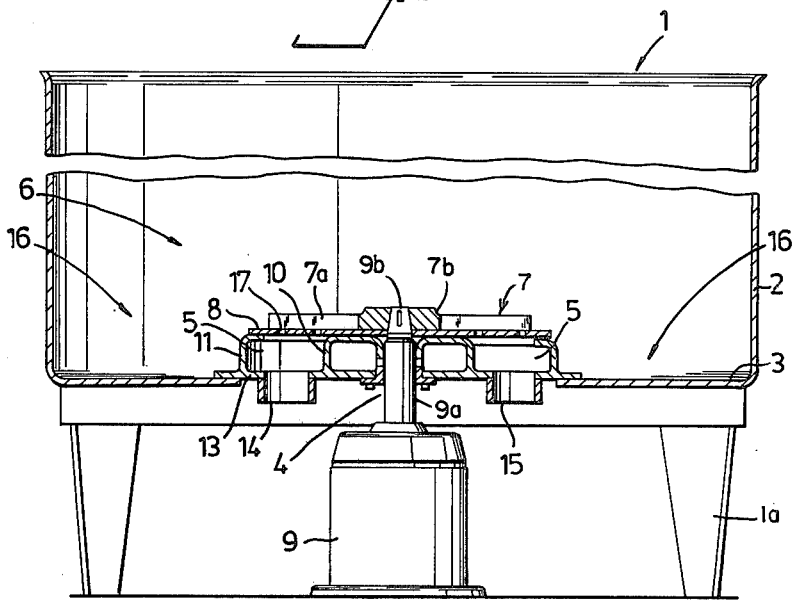
FIG. 1 is a longitudinal sectional view through one embodiment of apparatus, having the rotatable disintegrator concentrically mounted in the housing.
Figure 2:
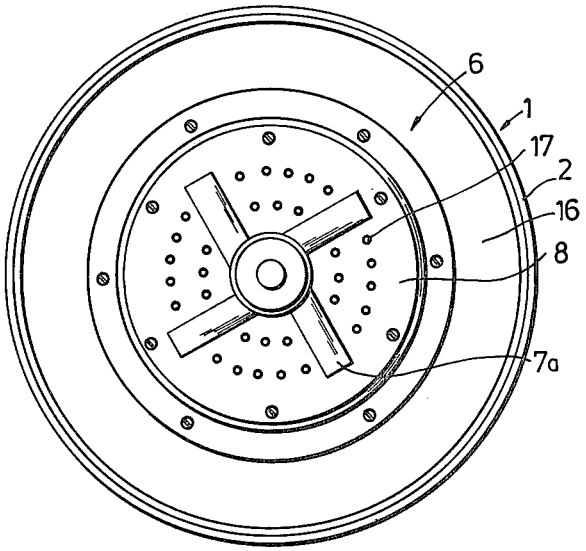
FIG. 2 is a top plan view of the apparatus of FIG. 1, looking down into the interior of the housing.

The apparatus shown in FIGS. 1 and 2 comprises an open top cylindrical tank 1 that has a side wall 2 and a bottom 3. While the drawing shows these parts to be integral, they can of course be separate, and merely attached together in a leak-tight manner, such as by welding, or bolted together with application of a watertight adhesive along the seam between the sides and bottom.

The tank is supported above the base on a plurality of legs 1*a*. Mounted in a central position between the legs, beneath the bottom 3, is a motor 9, having a rotatable shaft 9*a* extending upwardly through an aperture 4 in the bottom 3 of the tank. The shaft terminates in a stub 9*b*, on which is mounted for rotation with the shaft the hub 7*b* of a disintegrator rotor 7, having four propeller blades 7*a* placed symmetrically about and extending horizontally from the hub 7*b*. The blades are preferably flat and rectangular, and set at an angle of 90° to the horizontal, but they can have any configuration, can be twisted instead of flat, and can be at any angle to the horizontal, such as from 10° to 90°. Operation of the rotor 9 rotates the shaft 9*a*, and with it the rotor 7.

Fixed across the aperture 4 are two plates 8, 13. The plate 8 has a plurality of apertures 17, which serve to screen out paper fibers and particles larger than the diameter of the apertures, and consequently ensure that the larger particles are disintegrated sufficiently before they can escape from the tank. The lower plate 13 is provided with two outlet ports 14, 15, for withdrawing the aqueous slurry of disintegrated paper fibers and particles from the tank. These ports are connected to conduits (not shown) which carry the slurry to another portion of the system, for further processing, or for screening out of the recovered paper fibers and packaging.

The upper and lower plates 8, 13 define therebetween an outlet chamber 5, with cylindrical side wall 11, held fixedly in position in a leak-tight manner between the plates 8, 13. The plate 13 is attached to the bottom 3 of the tank by screws (not shown), but it can also be welded thereto, if desired.

The side walls 11 of the chamber 5 and the tank side wall 2 and bottom wall 3 define therebetween a well 16, which extends radially outwardly from the wall 11 of the outlet chamber, beneath the outer periphery of the vortex formed in the tank above the level of the well by the rotor 7. Since the well is closed on all sides except the top, and is below the rotor, it defines a relatively quiescent zone, into which the vortex created by the rotor does not penetrate appreciably. While there may be some circular flow of the slurry in the well, it is considerably less than the flow above the well, sufficiently less that the metallic and other heavy particles can settle out by gravity after they enter the well. On the other hand, the lighter disintegrated paper fibers and particles tend to move towards the center of the vortex, to the portion of the inner periphery of the vortex above the plate 8, where they are readily withdrawn by the flow of slurry through the apertures 17 via the outlets 14, 15. Since this region is substantially free from the heavy metallic and other particles, the slurry is accordingly separated from such particles before withdrawal from the tank.

The apparatus is operated as follows: First, the rotor 7 is started up by turning on the motor 9, after which water and waste paper or broke are charged through the open top of the tank. The rotor creates a strong cyclonic or vortical flow in the resulting aqueous slurry, with an appreciable amount of centrifugal force in the flow, because of the circular movement. The rotor also creates a flow radially outwardly to the wall of the tank, upwardly along the wall of the tank, and then back to the center, and down towards the rotor. By adjusting the rate of rotation of the rotor, and the amount of water in the tank, the waste paper material is drawn into the rotor, where it is shredded both by collision with the rotor and by the shearing forces of the vortex created by the rotor. The paper is moved about until it has reached a size small enough to permit it to pass through the apertures 17 in the plate 8, and when it does so it enters the outlet chamber 5, and is then withdrawn through one of the outlets 14, 15.

The heavy metallic and other similar heavy material thrown to the outer periphery of the vortex settles out by gravity in the region directly above and within the well 16, and collects in the well. Since the vortex does not enter the well which is relatively quiescent, such heavy particles are not entrained again, but remain there, and can be removed from time to time, after a sufficient amount has been collected. Since the particles remain relatively quiescent on the bottom 3 of the well, they do not abrade the walls, or the surfaces of the rotor above. From time to time the material collected in the well can be removed, as, for example, by a grab and traverse, or by providing a trap door in the well, either in the side or at the bottom, from which the material can be withdrawn. The tank can be emptied for the purpose, whereupon the material can be withdrawn through the trap with water in the well, which will aid in carrying the particles collected in the well out the trap.

At the center of the vortex there is a region of low pressure, and the lighter paper material tends to collect here. In this region there are virtually no centrifugal or shear forces applied, since there is virtually no vortex flow. Eventually, however, the material collected in the vortex is drawn down again towards the rotor, and then scattered out again by the rotor itself, and at this time such material collides with the rotor blades, and is entrained again in the vortex, for shredding action.

Figure 3:
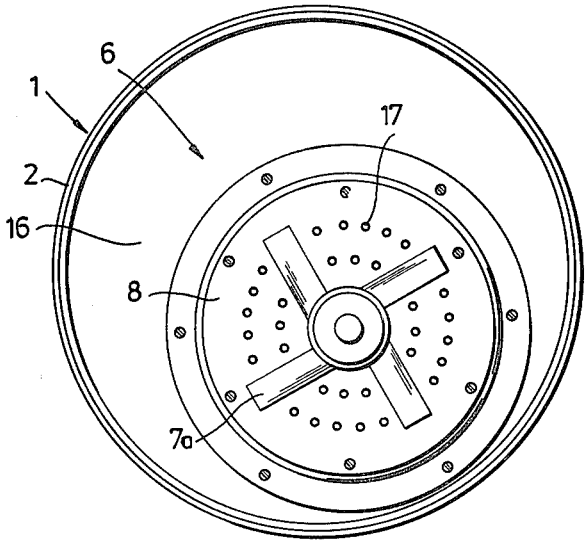
FIG. 3 is a top plan view of another embodiment of apparatus in accordance with the invention, in which the rotatable disintegrator is eccentrically mounted in the chamber.

The collection of non-disintegrated paper material in the center of the vortex is inhibited if the disintegrating device is arranged not concentrically in the tank, as in FIG. 1, but eccentrically, as in FIG. 3. When the disintegrator is arranged eccentrically, the velocity of the vortex at the periphery is different, according to the distance from the center of the vortex, and the forces at the center of the vortex are likewise unequal, because of the resulting turbulent flow, with the result that the material does not collect so readily at the vortex, but is instead thrown out more rapidly, because there is a higher flow from the periphery of the vortex towards the center, at the top of the tank, and down the vortex towards the rotor, at the bottom. Thus, material which tends to collect in the center is more rapidly flushed out, and returned to the vortex, for further disintegration and shredding action.

The operation of the apparatus shown in FIGS. 1 and 2 is illustrated by the following Example, which represents a preferred embodiment of the process and apparatus of the invention:

EXAMPLE 1

The apparatus used in this Example had the following specifications:

| | Diameter | Height |
|---|---|---|
| Tank, cylindrical | 4800 mm | 3000 mm |
| Well, annular | outer 4800 mm | 300 mm |
| | inner 2400 mm | |
| Outlet Chamber | 2400 mm | 300 mm |
| Outlet, diameter | 400 mm | |

The rotor 7 was started up by turning on the motor 9, after which 30 tons of water and 2 tons of waste paper or broke from business use, containing staples, paper clips, baling wire fragments, and like metal particles, were successively charged through the open top of the tank. The rotor created a strong cyclonic or vortical flow in the resulting aqueous slurry, with an appreciable amount of centrifugal force in the flow, because of the circular movement. The rotor also created a flow radially outwardly to the wall of the tank, upwardly along the wall of the tank, and then back to the center, and down towards the rotor. Operation of the rotor at a rate within the range from 100 to 120 rpm resulted in a vortex in which the waste paper material was drawn into the rotor, where it was shredded both by collision with the rotor and by the shearing forces of the vortex. The paper after it had reached a size small enough to permit it to pass through the apertures 17 in the plate 8 passed into the outlet chamber 5, and was then withdrawn through one of the outlets 14, 15.

The metallic and other similar heavy material thrown to the outer periphery of the vortex settled out by gravity in the region directly above and within the well 16, and collected in the well. The slurry in the well was relatively quiescent, and the heavy particles that settled out were not entrained again in the swirling slurry above but remained there, and were removed from time to time, after a sufficient amount had been collected. Since the particles remained relatively quiescent on the bottom 3 of the well, they did not abrade the walls of the well or the surfaces of the rotor above.

The aqueous slurry of paper fibers and particles withdrawn at outlets 14, 15 was substantially free of metallic particles, and the apparatus operated without breakdown due to metallic particle intrusion for a period of months.

Figure 4:
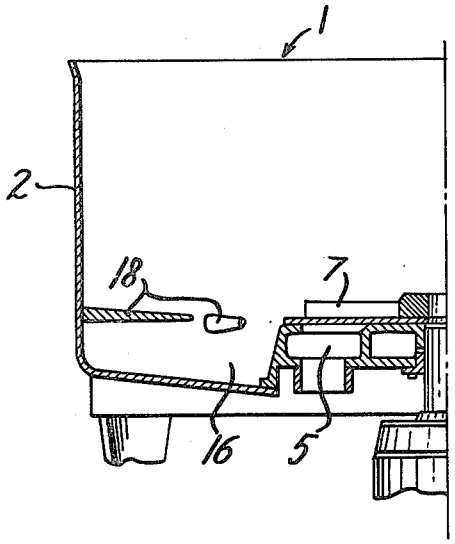
FIG. 4 is a longitudinal sectional view through another embodiment of apparatus in which the bottom of the tank and well is inclined downwardly towards the side wall of the weir.
Figure 5:
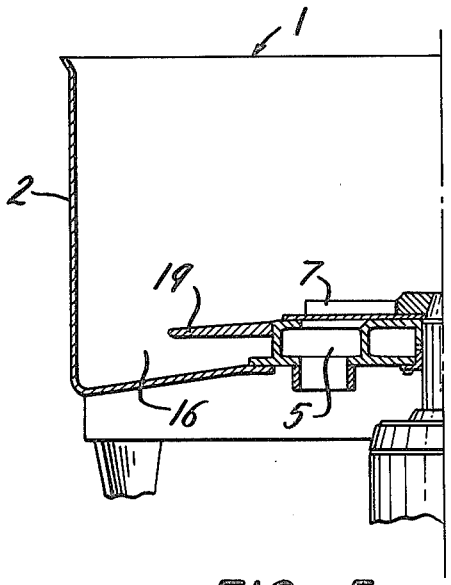
FIG. 5 is a longitudinal sectional view through another embodiment of apparatus in which the bottom of the tank and well is inclined downwardly towards the outer wall of the tank.

If desired, quiescence of the liquid in the well 16 can be enhanced by providing baffles in the well, which tend to interfere with vortical flow. These baffles can take the form of, for example, pegs, dividing walls, or projections, as shown in FIGS. 4 and 5 all of which interfere with flow across the bottom, and thus tend to prevent the material collected in the well from moving about and abrading the wall surfaces. Moreover, the material can collect on or against the pegs or baffles, walls or projections, stopping the material from moving about.

FIGS. 4 and 5 illustrate baffles in the form of projections from a side wall of the well. In the embodiment of FIG. 4, the baffle 18 extends inwardly from the side wall 2 of the tank, and in the embodiment of FIG. 5 the baffle 19 extends inwardly from the side wall 11 which constitutes a weir.

Figure 6:
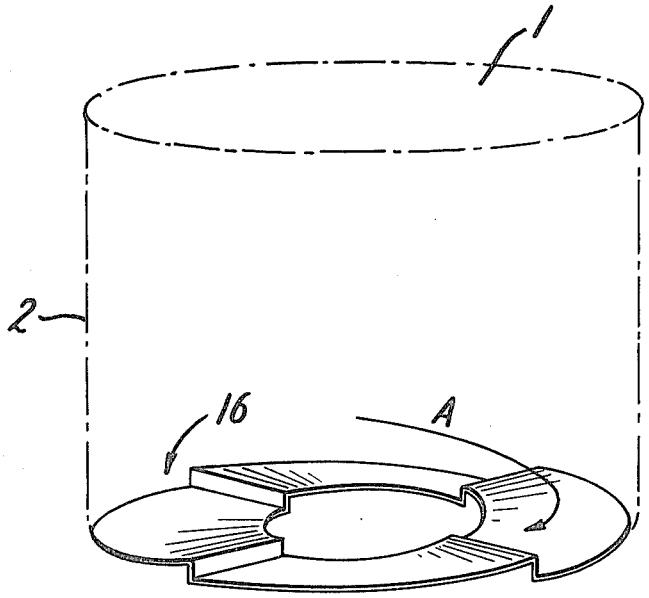
FIG. 6 is a longitudinal sectional view through another embodiment of apparatus in which the well is provided with four stepped portions in which the metallic material can collect.

The bottom of the well can also be made uneven, with raised and lowered levels, either throughout its surface, or at one end. Thus, for example, the well can be provided with one or more stepped portions, as shown in FIG. 6, or recesses or grooves in which the metallic material can collect. This tends to restrict the collected material to certain portions of the well, and consequently facilitates the removal of the material.

The bottom of the well also can be inclined either downwardly towards the outer wall of the tank, as shown in FIG. 5, or, as shown in FIG. 4, downwardly towards the wall 11, which constitutes a weir, since flow into the outlet chamber 5 through the aperture 17 of plate 8 can only proceed over the top of the weir. The material collected in the well will then tend to be concentrated at the lowermost portion of the well, which again facilitates removal.

While the tank illustrated is in the shape of a cylinder, it can of course have any desired cross-sectional configuration, such as square, rectangular, polygonal or elliptical. A cylindrical tank is, however, preferred.

Having regard to the foregoing disclosure, the following is claimed as the inventive and patentable embodiments thereof:

1. A process for disintegrating waste paper containing metallic and other particulate material appreciably heavier than the paper, and separating the heavier material from an aqueous slurry of disintegrated paper fibers and particles by centifugal force and gravity settling, comprising disintegrating waste paper in a vessel having a disintegrating rotor at the bottom of the vessel in the presence of water while imparting a vortical flow to the resulting slurry, of a velocity sufficient to throw relatively heavy particulate material towards the outer periphery of the resulting vortex, while lighter waste paper fibers and particles move towards the inner periphery of the vortex; establishing a relatively quiescent continuous annular zone surrounding and below the rotor and outer periphery of the vortex, all of which zone including the entry thereto is below the rotor; permitting the heavier particulate material to settle out and collect in that zone; and withdrawing a slurry of waste paper fibers and particles from an inner peripheral portion of the vortex above the rotor, relatively free from heavier metallic particulate material.

2. A process according to claim 1, which comprises withdrawing collected heavier particulate material from time to time while simultaneously continuously carrying out the process.

3. An apparatus for separating the metallic and other particulate material heavier than paper from the disintegrated paper fibers and particles in a manner which prevents the separated metallic and other heavy material from abrading the tank and rotor, which comprises, in combination, a housing; a disintegration chamber in the housing; a disintegrating rotor mounted at the bottom of the chamber for disintegrating waste paper in the presence of water and imparting a vortical flow to the resulting slurry of a velocity sufficient to throw relatively heavy particulate material towards the outer periphery of the resulting vortex while waste paper fibers and particles move towards the inner periphery of the vortex; at least one outlet in the chamber adjacent the inner periphery of the vortex and below the rotor for withdrawing a slurry of waste paper fibers and particles; a filter across the outlet permitting only waste paper fibers and particles below a predetermined size to escape from the chamber; and a continuous annular well in the chamber below the level of the outlet all of which well including the entry thereof is surrounding and below the rotor and extending beneath at least the outer periphery of the vortex, radially outward from the outlet, for collection of heavy particulate material thrown to the outer periphery of the vortex and settling out by gravity in a relatively quiescent zone within the well.

4. An apparatus according to claim 3, having the rotor concentrically arranged in the chamber along the axial center line thereof.

5. An apparatus according to claim 3, having the rotor eccentrically arranged in the chamber, not along the axial center line of the chamber.

6. An apparatus according to claim 3, having the bottom of the well inclined downwardly towards the rotor.

7. An apparatus according to claim 3, having the bottom of the well inclined downwardly towards the peripheral wall of the chamber.

8. An apparatus according to claim 3, having a plurality of baffles disposed in the well.

9. An apparatus according to claim 3, having a plurality of stepped levels disposed in the well bottom.

* * * * *